US005593746A

United States Patent [19]

Siniscalchi et al.

[11] Patent Number: 5,593,746

[45] Date of Patent: Jan. 14, 1997

[54] THERMALLY INSULATING BATT FOR WINTER APPAREL, QUILTS, SLEEPING BAGS AND THE LIKE, THE PROCESS OF PREPARATION THEREOF AND FABRICS TOGETHER AND THE THERMALLY INSULATING BATT

[76] Inventors: Lucio Siniscalchi; Marciano Siniscalchi, both of Via Milano, 52, 22059, Robbiate (Como), Italy

[21] Appl. No.: 235,546

[22] Filed: Apr. 29, 1994

Related U.S. Application Data

[63] Continuation-in-part of Ser. No. 942,750, Sep. 9, 1992, abandoned, which is a continuation of Ser. No. 688,031, Apr. 19, 1991, abandoned, which is a division of Ser. No. 424,803, Oct. 19, 1989, abandoned, which is a continuation of Ser. No. 103,356, Sep. 30, 1987, abandoned.

[30] Foreign Application Priority Data

Jun. 30, 1987 [IT] Italy ..... 21127/87

[51] Int. Cl.[6] ..... A41D 31/02; B32B 5/14; B32B 33/00

[52] U.S. Cl. ..... 428/36.1; 2/69.5; 19/98; 28/122; 428/36.2; 428/68; 428/236; 428/288

[58] Field of Search ..... 428/288, 36.1, 428/36.2, 68, 236; 2/69.5; 19/98; 28/122

[56] References Cited

U.S. PATENT DOCUMENTS 4,356,229 10/1982 Brodnyan ..... 428/288

*Primary Examiner*—James C. Cannon
*Attorney, Agent, or Firm*—Bucknam and Archer

[57] ABSTRACT

An improved thermally insulating batt particularly designed for use as filling material for winter apparel, quilts, sleeping bags and the like, is produced by first preparing carded webs consisting of natural or synthetic fibers, plying several webs to form a batt, and then subjecting this batt to a subsequent resin treatment, on at least one face thereof, by using specific cross-linked glues. The resin treated batt is then calendered, under controlled temperature and pressure conditions, so as to obtain, on its surface, a soft, resilient and heat-sensitive film and, in the interior, an air chamber so as to provide a low thermal exchange coefficient and a proper control of the body temperature.

10 Claims, No Drawings

THERMALLY INSULATING BATT FOR WINTER APPAREL, QUILTS, SLEEPING BAGS AND THE LIKE, THE PROCESS OF PREPARATION THEREOF AND FABRICS TOGETHER AND THE THERMALLY INSULATING BATT

This application is a continuation-in-part of U.S. Ser. No. 942,750 filed Sep. 9, 1992, now abandoned, which was a continuation of U.S. Ser. No. 688,031 filed Apr. 19, 1991, now abandoned, which was a Divisional of U.S. Ser. No. 424,803, filed Oct. 19, 1989, now abandoned which was a continuation of U.S. Ser. No. 103,356, filed Sep. 30, 1987, now abandoned.

FIELD OF THE INVENTION

The present invention relates to an improved batt having improved thermal insulation characteristics, particularly designed for use as filling material in winter apparel, quilts, sleeping bags and the like. The application also relates to the apparel, quilts, sleeping bags which contain the batt according to the present invention.

The term "batt" as used herein means the fiber web plus the glue.

BACKGROUND OF THE INVENTION

In a previous Italian Patent application of Lucio Siniscalchi, one of the applicants (Italian Patent Application No. 20,978 A/84 filed on May 17, 1984, which is incorporated herein for reference), there was illustrated a method for making a batt to be used in winter apparel and furniture, which essentially comprised the step of mixing preferably polyether and siliconized polyester fibers so as to provide, upon a carding treatment, a soft batt.

This batt was then coated, on one or both of its faces, with a glue mixture, of a specifically designed formulation, so as to provide, upon cross-linking, a very soft and resilient film on said surfaces. The batt processed in this manned was then subjected to a calendering step, under variable temperatures and pressures, in order to substantially reduce its initial thickness. During the calendering step, for a short predetermined time, one of the cylinders of the calendering machine was held into contact with the surface being processed so as to provide an expansion of the batt capable of substantially forming an air chamber in the interior of the batt.

The batt described above had greatly improved thermal insulation characteristics with respect to known batts, which, moreover, had a very high thickness, which prevented them from being satisfactorily applied in the field of winter apparel, quilts, sleeping articles and the like.

While the batt according to the above mentioned Italian Patent application has provided good results, it has been found that its properties may be further improved.

SUMMARY OF THE INVENTION

One object of the present invention is to provide an improved batt with superior thermal insulation properties so as to facilitate the production of a more compact article of manufacture which may be easily used in the apparel field.

Another object of the present invention is to provide a batt which, in addition to having very good thermal insulation characteristics, also affords the possibility of dynamically adjusting the thermal exchange coefficient and thus the body temperature in response to changes in the degree of physical activity of the wearer as well as in the outside temperature.

Still another object is to provide winter apparel, sleeping bags and quilts provided with the batt according to the present invention.

Still another object of the present invention is to provide a method of making batts which may be simply and quickly carried out and which, moreover, can provide an aesthetically satisfactory product capable of being easily processed.

The process according to the present invention for making a batt suitable for winter apparel, quilts, sleeping bags and the like comprises the steps of:

providing, by means of carding or other suitable machines, one or more webs obtained from natural or synthetic fibers;

plying the webs thus obtained to form a batt, by means of lappers or other suitable machines;

resin treating the batt, on at least one of its surfaces, by using at least one particular glue or mixture of glues, whose essential characteristics are indicated herein;

drying and curing the resins to ensure cross-linking;

calendering the resin treated batt under controlled temperature and pressure conditions in order to provide, on its surface, a film and, in its interior, an air chamber, so as to obtain a low thermal exchange coefficient as well as dynamic adjustment of said coefficient, and thus of the body temperature.

The fibers which may be used in the process according to the present invention may be polyester fibers, polyethylene terephthalate fibers, acrylic fibers, polyammide fibers, polyolefin fibers, as well as natural fibers, such as vegetable and animal fibers and mixtures of synthetic and natural fibers.

In order to resin-treat the batt, specifically designed glues are used, the chemical formulation of which is very important to obtain the above mentioned thermal insulation, dynamic thermal exchange coefficient adjustment and aesthetic properties.

More specifically, according to the present invention, at least one glue is applied consisting essentially of (a) from about 50% to about 90% by weight of an emulsion of an acrylic copolymer having a glass transition temperature from −15° to +40° C., and (b) from about 10% to about 50% by weight of an emulsion or dispersion of a polymer, said polymer being a member of the group of aliphatic and aromatic polyurethanes, polyethers and polyesters, acrylics or meta-acrylics, said polymer having a glass transition temperature (Tg) of −60° C. to −12° C., a minimum film-forming temperature (MFT) from 0° C. to 9° C., the emulsion or dispersion having a density from 1.02 to 1.06 g/cm$^3$, a pH from 3.2 to 10.4, a viscosity from 30 to 900 mPa's and a particle size from 0.015 to 0.35 microns.

Note that other additives and components may be added to the above basic formulation in order to facilitate production. Details are given in the following section.

DETAILED DESCRIPTION OF THE INVENTION

As indicated, the process according to the present invention comprises three main steps:

1. providing, by means of carding or other suitable machines, one or more webs obtained from natural or synthetic fibers; webs thus obtained are then plied to form a batt, by means of lappers or other suitable machines;

2. resin treating the batt, on at least one of its surfaces, by using at least one particular glue or mixture of glues, 3. Drying and curing the resins to ensure cross-linking.

4. calendering the resin treated batt under controlled temperature and pressure conditions in order to provide, on its surface, a film and, in its interior, an air chamber, so as to obtain a low thermal exchange coefficient as well as dynamic adjustment of said coefficient, and thus of the body temperature.

As indicated, the fibers which may be used in the process according to the present invention may be polyester fibers, polyethylene terephthalate fibers, acrylic fibers, polyamide fibers, polyolefin fibers, as well as natural fibers, such as vegetable and animal fibers and mixtures of synthetic and natural fibers. While the type of fibers used in Step 1 influences the aesthetic and thermal properties of the batt, the use of specially designed glues as per Step 2, and the final calendering process as per Step/4, make it possible to impart a pleasant touch and handfeel to the batt, to adjust its thickness to the desired level and to make the batt sensitive to changes in the outside temperature and/or to the amount of heat released by the body, which varies with the degree of physical activity.

Thus, while a preferred realization of the process according to the present invention uses poly(ethylene terephthalate) fibers, the ability to impart pleasant aesthetic characteristics and improved thermal resistance to batts consisting of a wide range of fibers constitutes an important advantage of the present invention.

As indicated, according to the present invention the resin sprayed on at least one side of the batt in Step 2 consists essentially of (a) from about 50% to about 90% by weight of an emulsion of an acrylic copolymer such as Union Carbide So896, H-890 or M-607(see Table 1 in the following section), said acrylic copolymer having a glass transition temperature from −15° to +40° C. (hereinafter referred to as "type (a) component"), and (b) from about 10% to about 50% by weight of an emulsion or dispersion of a polymer, said polymer being a member of the group of aliphatic and aromatic polyurethanes, polyethers and polyesters, acrylics or meta-acrylics, said polymer having a glass transition temperature (Tg) of −60° C. to −12° C., a minimum film-forming temperature (MFT) from 0° C. to 9° C., the emulsion or dispersion having a density from 1.02 to 1.06 g/cm$^3$, a pH from 3.2 to 10.4, a viscosity from 30 to 900 mPa·s and a particle size from 0.015 to 0.35 microns (hereinafter referred to as "type (b) component").

Note that both type (a) and type (b) components must be resins of the crosslinking type to ensure resistance to repeated washing and dry cleaning. In order to expedite crosslinking and, more generally, to facilitate the production process, (c) a cross-linking agent, (d) a surfactant, or wetting agent, (e) an antifoaming agent and (f) a slipping agent may optionally be added. The addition of such agents does not affect the aesthetic and thermal characteristics of the batt according to the present invention.

Note that some commercially available polymer emulsions contain some of all of the components listed under (c), (d), (e) and/or (f), while other emulsions do not require the addition of such components.

The final calendering step (Step 3) serves a twofold purpose: it creates an air chamber, or air pocket, in the interior of the batt, and it creates a film, or layer, which makes the batt react to changes in the outside temperature or in the amount of heat released by the wearer's body by changing the batt's overall thermal exchange coefficient.

Said dynamic, or reactive, film is created on at least one face of the batt, i.e. the face on which the glue formulation disclosed above is sprayed.

During the calendering step, for a short predetermined time, one of the cylinders of the calendering machine is held into contact with the surface being processed so as to provide an expansion of the batt capable of substantially forming an air chamber in the interior of the batt. However, the resin formulation disclosed herein greatly facilitates the expansion of the batt, and hence the formation of an air chamber. This is essentially due to the low Tg values (−60° C. to −12° C.) of the type (b) component of the above mentioned formulation. Tg values correspond to the temperature at which the polymer enters the vitreous (glass) stage. At temperatures higher than the glass transition temperature, glues consisting of the specific polymers indicated in the formulation disclosed herein are essentially softer and stickier, and expand (or contract) more rapidly (i.e. to a larger extent) in the event of a temperature change, than at temperatures lower than Tg. Thus, the lower the Tg value, the stickier the glue will be at any given operating temperature of the calender. This, in turns, leads to a higher degree of expansion of the interior of the bait than previously achieved.

The second purpose of the calendering step is to make the batt reactive to temperature and body heat changes. The calendering process tends to concentrate a substantial amount of resin particles on the face of the batt (that is, on the only face sprayed with the disclosed formulation, or on both faces, if both are sprayed with it). The film or layer thus created acts as a dynamic interface between the surrounding environment and the barrier and air pocket layers of the batt.

More specifically, consider an increase in the outside temperature. Owing to their low glass transition temperature, glue drops, which are located at the intersection of fibers (and, more specifically, as a consequence of the calendering step, at the intersection of fibers on the surface of the batt), tend to expand. This causes changes in the convective properties of the batt. Warm air trapped in the air pocket by the barrier and interface layers can now escape towards the outside environment with greater ease.

At the same time, and especially in a preferred realization of the present invention, where the type (b) component of the glue formulation is actually a polyester-polyurethane elastomer, the thermal conductivity of the polymer itself increases. Note that changes in conductivity in response to temperature changes are exhibited by most elements, substances, solutions or composites; for example, water and air tend to be more conductive at high temperatures than at low ones, while the opposite is true of most metals. However, such changes are generally negligible over the temperature range from about −20° C. to about +10° C., which is most relevant for winter apparel or sleeping bag applications. As the Examples in the following section show, this is not true for the specific glue formulations disclosed herein.

An increase in the thermal conductivity of the glues substantially amounts to short-circuiting the barrier layers: it tends to increase the overall heat dissipation through the batt.

Thus, as the outside temperature increases, the batt according to the present invention releases a greater quantity of heat which, if kept within the garment or sleeping bag, would cause the wearer's body to sweat. The mechanisms described above also work in the opposite direction, i.e. the overall heat dissipation through the batt decreases when the outside temperature drops. This adjustment process improves the wearer's (or user's) comfort by essentially stabilizing his or her body temperature.

Note that, while one could in principle increase the extent of this adjustment process by using exclusively type (b) components, instead of a mixture of type (a) and type (b) components, the sprayed batt would be too sticky to the touch and difficult to handle during the garment or sleeping bag manufacturing process.

Also, while the chemical characteristics of the glue formulation alone would be sufficient, in principle, to endow the sprayed batt with the kind of self-adjustment properties disclosed in the present invention, it has been found by experiment that the extent of such self-adjustment is maximized by calendering the sprayed batt.

EXAMPLES

Eight different emulsions were sprayed on individual batts weighting approx. 170 g/m$^2$ obtained by carding poly(ethylene terephthalate) fibers. The thickness before the calendering step was approx. 3 cm; after calendering, the thickness was set to 2 cm ±5%. The final resin content of the sprayed batt was set to 25% of the total weight.

Table 1 summarizes the types of emulsions used in this series of tests:

TABLE 1

| | Emulsion Examples | | | | |
|---|---|---|---|---|---|
| Emulsions | A | B | C | D | E |
| Example: | BASF Luphen D-200A | UCAR Latex S-896 | UCAR Latex M-607 | UCAR Latex H 890 | UCAR Latex H 806 |
| Chemical Nature | Aromatic Polyurethane Elastomer | Acrylic Copolymer | Acrylic Polymer Emulsion | All Acrylic Emulsion (1) | All Acrylic Emulsion (2) |
| Solids Contents (%) | 40 | 46–48 | 50–51 | 44–46 | 44–46 |
| Density g/cm$^3$ | 1.06 | 1.0–1.1 | 1.0–1.1 | 1.0–1.1 | 1.05–1.1 |
| pH | 8–9 | 2–3 | 2–3 | 2–3 | 1.5–2.5 |
| Viscosity | 50–150 mPa.s | 10–100 cps | 10–50 cps | <100 cps | <100 cps |
| Particle Size µm | 0.2 | 1.0 MAX | 1.0 MAX | 0.3–0.4 | 0.3–0.4 |
| Filming Temperature °C. | 9 | <0 | <25 | 0 | 42 |
| Ionic character | anionic | anionic | anionic | anionic | anionic |
| Tg °C. | –46 | –15 | 16 | 0 | 48 |

Note:
"mPa.s" = "milliPascal per second"; "cps" = "centipoise"

BASF Luphen D200A is manufactured and marketed by BASF, whereas the remaining emulsions are manufactured and marketed by Union Carbide.

Table 2 summarizes the glue compositions of Examples 1–8.

TABLE 2

| | Examples of Glue Composition | | | | | | | |
|---|---|---|---|---|---|---|---|---|
| Example n. | 1 | 2 | 3 | 4 | 5 | 6 | 7 | 8 |
| Emulsion A p.p. | 100 | — | — | — | — | 30 | 30 | 30 |
| Emulsion B p.p. | — | 100 | 70 | — | — | 60 | — | — |
| Emulsion C p.p. | — | — | 30 | — | — | 10 | — | — |
| Emulsion D p.p. | — | — | — | 100 | 90 | — | 70 | 65 |
| Emulsion E p.p. | — | — | — | — | 10 | — | — | 5 |
| Deionized water | 100 | 100 | 100 | 100 | 100 | 100 | 100 | 100 |
| Antifoaming Agent | 0.1 | 0.1 | 0.1 | 0.1 | 0.1 | 0.1 | 0.1 | 0.1 |
| Surfactant | 0.1 | 0.1 | 0.1 | 0.1 | 0.1 | 0.1 | 0.1 | 0.1 |

TABLE 2-continued

| | Examples of Glue Composition | | | | | | | |
|---|---|---|---|---|---|---|---|---|
| Example n. | 1 | 2 | 3 | 4 | 5 | 6 | 7 | 8 |
| Cross-linking Agent | 0–0.5 | 0–0.5 | 0–0.5 | 0–0.5 | 0–0.5 | 0–0.5 | 0–0.5 | 0–0.5 |
| Slipping Agent | 0.01 | 0.01 | 0.01 | 0.01 | 0.01 | 0.01 | 0.01 | 0.01 |

Antifoaming agent: ex. Nopco NXZ - Nopco
Surfactant: ex. Triton x 100 - Rohm & Haas
Cross-linking agent: ex. Basonat A270 - BASF
Slipping agent: ex. Cirrasol - ICI Table 3 summarizes the properties of the sprayed batts.

TABLE 3

| | Characteristics of sprayed batts | | | | | | | |
|---|---|---|---|---|---|---|---|---|
| Example n. | 1 | 2 | 3 | 4 | 5 | 6 | 7 | 8 |
| Handfeel | soft, sticky | soft, sticky | soft | soft | soft | soft | soft | soft |
| Slippery? | yes | yes | yes | yes | yes | yes | yes | yes |
| Fiber Retention | very good | very good | very good | good | good | very good | very good | good |
| Thermal Resistance (*) | 0.391 | 0.380 | 0.380 | 0.382 | 0370 | 0.390 | 0.390 | 0.387 |
| Hot Water Test (**) | 25 | 20 | 12 | 12 | 10 | 22 | 21 | 20 |
| Thermal boost (***) | 20 | 16 | 8 | 9 | 7 | 18 | 18 | 17 |

(*) according to UNI 7745; values are m$^2$°C./W
(**) see enclosed test description
(***) percent increase in thermal resistance when the "cold plate" temperature is lowered from +10° C. to –10° C.; measures conform to UNI 7745.

UNI 7745 is a standard testing procedure (the ASTM equivalent is C-518; also, ASTM D-1518 is close in principle to UNI 7745, although not strictly equivalent). Basically, a specimen of the material to be tested is sandwiched between two metal plates, whose temperature can be controlled. One is kept at a higher temperature than the other (which is possibly refrigerated), so heat flows from the former to the latter. In principle, if the tested specimen is a good insulator, little power must be supplied to the "hot" plate in order to keep it at the preset temperature, so that a good indication of the thermal resistance of the material can be obtained by simply recording the power actually supplied to the hot plate during the test. Thus, if P, h, dT, and S denote the power (W), thickness (m), temperature differential between the two plates (° C.), and testing surface in $m^2$ values recorded during a particular test, then the thermal resistance figure is given by S·dT/P'h.

In order to obtain thermal boost values, one runs two UNI 7745 tests for each specimen. In the first test, the "hot plate" is kept at a temperature of approx. +37° C., while the "cold plate" is held at +10° C.; denote the thermal resistance figure (obtained according to the previous formula) by $r_1$. For the second test, the "hot plate" is still held at 37° C., but the "cold plate" temperature is kept at −10° C.; denote the value thus obtained by $r_2$. The thermal boost value is then given by $(r_2-r_1)/r_1$. Thus, thermal boost values essentially indicate how much warmer a batt becomes when the outside temperature drops.

Table 3 shows that three glue formulations (Examples 6, 7 and 8), which were prepared according to the present invention, display the the second- and third-highest thermal boost values. The emulsion according to Example 1 has the highest thermal boost value, but the handfeel of the batt is sticky, which, as explained in the preceding section, is undesirable.

While glue formulations according to 6, 7 and 8 vastly outperformed, from a reactivity standpoint, alternative resin compositions, one should also note that the thermal boost value for a conventional fine-denier 165 g/$m^2$ polyester-polyolefin batt was found to be only 5%.

The "hot water test" simulates changes in the body temperature. A highly conductive plastic vessel is filled with water at a temperature of 45° C. The vessel is then enclosed in a "jacket" made with the product being tested, and the probe of a digital thermometer is positioned inside the vessel. Said vessel is then plugged with cork and placed on an insulating base so as to prevent heat dissipation in directions other than those covered by the specimen.

The assembly is then placed in a controlled-temperature chamber. For the purpose of the present tests, the chamber temperature was set to 0° C.

In order to condition the system the test starts only when the water temperature reaches 41° C. A timer is then started, and the water temperature is recorder at 1-minute intervals for 20 minutes. The following table is then constructed:

| Time | Temperature | Dt |
|---|---|---|
| 1' | $t_1$ | (n.a.) |
| 2' | $t_2$ | $t_2 - t_1$ |
| 3' | $t_3$ | $t_3 - t_2$ |
| . | . | . |
| . | . | . |
| . | . | . |
| 20' | $t_{20}$ | $t_{20} - t_{19}$ |

A reading of the above table can help discriminate between batts which do exhibit the kind of self-adjustment behavior described herein, and batts which do not. A quantitative summary of the table can also be obtained as follows: let D137+ denote the average value of the Dt's corresponding to temperatures above 37° C., and let Dt37− denote the average value of the Dt's corresponding to temperatures of at most 37° C.; a "dynamic response index" can then be calculated as DRI+(Dt37+−Dt37−) / Dt37−. The figure thus obtained furnish an indication of percent increase in heat dissipation when the body temperature tends to rise above 37° C.

Clearly, DRI+ and thermal boost values can be expected to exhibit a high degree of positive correlation, and indeed Table 3 shows that this is the case: again, with the exception of Example 1, emulsions 6, 7 and 8 exhibit the highest degree of reactivity (this time, with respect to changes in the body temperature). Also, the DRI+ value for a common fine-denier 165 g/$m^2$ polyester-polyolefin batt was found to be only 5%.

What is claimed is:

1. A thermally insulating batt for use as a warmth-retaining padding produced by the steps of:

1) forming at least one web of synthetic or natural fibers of mixtures of synthetic and natural fibers by means of carding machines, plying said at least one web, said at least one web having two sides:

2) applying on at least one side of said web a resin glue or a mixture of glues comprising components:

a) 50%–90% by weight of an emulsion of an acrylic copolymer, which contains a cross-linking agent said acrylic copolymer having a glass transition temperature of −15° C.–+40° C. and b) 10%–50% by weight of an emulsion or dispersion of a polymer which contains a cross-linking agent, said polymer being a member of the group of aliphatic and aromatic polyurethanes, polyethers and polyesters, acrylics or meta-acrylics, said polymer having a glass transition temperature (Tg) of −60° C. to −12° C. and a minimum film-forming temperature (MFT) from 0° to 9° C., said emulsion or dispersion having a density from 1.02 to 1.06 g/$cm^3$, a pH from 3.2 to 10.4, a viscosity from 30 to 900 mPa.s and a particle size from 0.015 to 0.35 microns;

3) drying and heating said resin on said resin-treated batt; and 4) calendering said resin-treated batt from step 3) under controlled temperature and pressure conditions whereby an air chamber is obtained in the interior thereof, and a film is created on at least one face of said batt which has a low thermal exchange coefficient and a capability of dynamic adjustment to the wearer's body temperature, said thermally insulating batt exhibiting a low heat flow rate from an element whose temperature is 37° C. towards a cold 0° C. surrounding environment, and a 15% to 50% higher heat flow rate from an element heated at a temperature of about 38° C. to about 41° C. towards the same cold surrounding environment.

2. The batt according to claim 1 wherein said glue in step 2) additionally contains at least one of a surfactant, an anti-foaming agent and a slipping agent in both components a) and b).

3. The batt according to claim 2 wherein said cross-linking agent is added in the amount up to 0.5 parts per 100 parts of said glue composition.

4. The batt according to claim 1 wherein said at least one web in step 1) is a member selected from the group consisting of polyester fibers, acrylic fibers, polyamide fibers, polyolefin fibers, vegetable fibers, animal fibers and mixtures thereof.

5. The batt according to claim 4 wherein said at least one web in step 1) consists of polyethylene terephthalate.

6. The batt according to claim 1 which exhibits a low heat flow rate from an element whose temperature is 37° C. towards a cold (−10° C.) surrounding environment, and a 15% to 50% higher heat flow rate from an element heated at a temperature of 37° C. towards a warmer (+10° C.) surrounding environment.

7. The batt according to claim 1 in combination with a fabric.

8. The batt according to claim 2 in combination with a fabric.

9. The batt according to claim 4 in combination with a fabric.

10. The batt according to claim 5 in combination with a fabric.

* * * * *